US005174450A

United States Patent [19]

Upchurch

[11] Patent Number: 5,174,450

[45] Date of Patent: Dec. 29, 1992

[54] ROPE CONTAINER INSERT

[76] Inventor: David W. Upchurch, 190 Moffat, Box 143, Yampa, Colo. 80483

[21] Appl. No.: 846,872

[22] Filed: Mar. 6, 1992

[51] Int. Cl.[5] ..... B65D 85/04

[52] U.S. Cl. ..... 206/39.1; 206/388

[58] Field of Search ..... 206/388, 389, 391

[56] References Cited

U.S. PATENT DOCUMENTS

| | | | |
|---|---|---|---|
| 1,473,578 | 11/1923 | Greve | 206/388 |
| 3,599,828 | 8/1971 | Conway et al. | 206/391 X |
| 4,527,677 | 7/1985 | March et al. . | |
| 4,580,667 | 4/1986 | Herwood . | |
| 4,811,769 | 3/1989 | Phares . | |
| 4,887,751 | 12/1989 | Lehman . | |

FOREIGN PATENT DOCUMENTS

| | | | |
|---|---|---|---|
| 1111018 | 7/1961 | Fed. Rep. of Germany | 206/391 |
| 1244572 | 12/1964 | Fed. Rep. of Germany | 206/389 |

*Primary Examiner*—William I. Price

*Attorney, Agent, or Firm*—Henderson & Sturm

[57] ABSTRACT

A rope container insert including a concave base and a number of rigid vertical fins extending up from the base to form a number of cavities disposed to receive and store individual sections of rope. The two outermost fins are spaced inwardly from the lateral edges of the base such that two additional cavities are formed between the rope container walls and the outermost fins. An interior fin is located between the outermost fins and includes a handle opening for moving the insert in and out of the rope containers or transferring the insert from one rope container to another. The insert is adapted for use in both rope bags and rope cans.

7 Claims, 1 Drawing Sheet

ROPE CONTAINER INSERT

Technical Field

This invention relates to carrying cases, and more particularly to an insert for a rodeo rope bag or rope can.

BACKGROUND

A rope bag or rope can is a container used by team ropers or calf ropers to carry their tools, i.e., ropes, to rodeos. Some ropes are expensive and very necessary for the rodeo cowboys' livelihood and several ropes are generally needed by each cowboy. When several ropes are stored in a rope bag or rope can, the tendency is for the ropes to get tangled together. This results in aggravation and lost time in untangling the ropes to put them in condition to use.

Those concerned with these and other problems recognize the need for an improved insert for a rope container.

DISCLOSURE OF THE INVENTION

The present invention provides a rope container insert including a concave base and a number of rigid vertical fins extending up from the base to form a number of cavities disposed to receive and store individual sections of rope. The two outermost fins are spaced inwardly from the lateral edges of the base such that two additional cavities are formed between the rope container walls and the outermost fins. An interior fin is located between the outermost fins and includes a handle opening for moving the insert in and out of the rope containers or transferring the insert from one rope container to another. The insert is adapted for use in both rope bags and rope cans.

An object of the present invention is the provision of an improved rope container insert.

Another object is to provide a rope container insert that is simple in structure and inexpensive to manufacture.

A further object of the invention is the provision of a rope container insert that is durable and easy to maintain.

Still another object is to provide a rope container insert that is versatile and easily adapted to containers of different types.

A still further object of the present invention is the provision of a rope container insert that is lightweight and easy to use.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
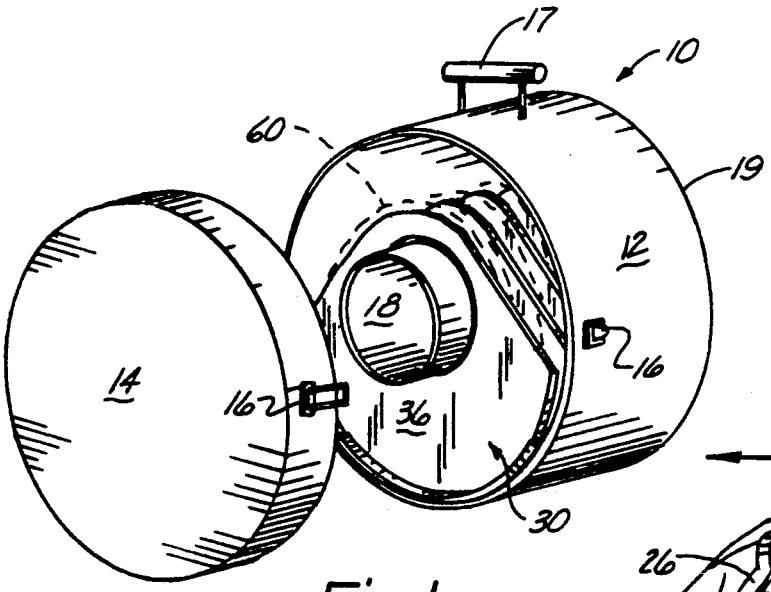
FIG. 1 is a perspective view of the rope container insert of the present invention used in a rope can formed of rigid material.
Figure 2:
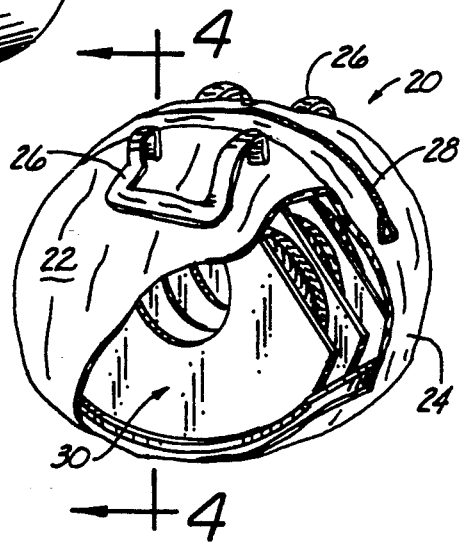
FIG. 2 is a cutaway perspective view of the rope container insert used in a rope bag formed of flexible material.

Referring now to the drawings, wherein like reference numerals designate identical or corresponding parts throughout the several views, FIG. 1 shows the rope container insert (30) of the present invention used in a rope can (10), and FIG. 2 shows the insert (30) used in a rope bag (20). The rope can (10) is made of rigid material and includes a main body section (12) and a cover (14) that forms a vertical wall. The cover (14) is attached to the body section (12) by a pair of latches (16). A hand grip (17) extends from the body section (12) and a circular projection (18) extends from the vertical sidewall (19) of the body section (12).

The rope bag (20) illustrated in FIG. 2 is made of flexible material that forms a container having a pair of vertical sidewalls (22) and an intermediate section (24) joining the sidewalls (22). Hand grips (26) are attached to opposite sidewalls (22) and a zippered opening (28) provides access to the interior of the bag (20).

Figure 3:
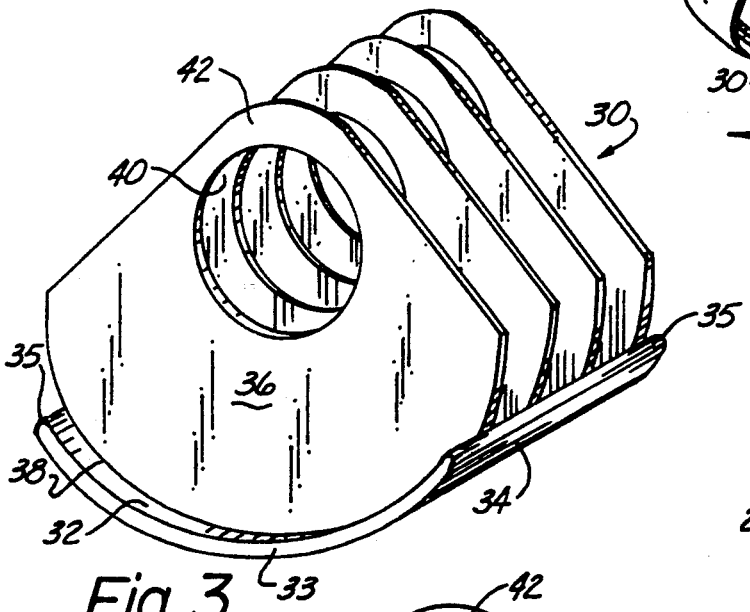
FIG. 3 is an enlarged perspective view of the rope container insert.

As most clearly shown in FIG. 3, the rope container insert (30) includes a rigid rectangular base (32) having a concave lower surface (34) and rounded corners (35). A number of vertical rigid fins (36) having lower convex edges (38) are attached to the base (32) at regular intervals. The outermost fins are spaced inwardly from the lateral edges (33) of the base (32). Circular openings (40) are formed in the upper section of the fins (36) to form a handle (42). The circular opening (40) is sized to be about one-half of the height of the fin (36).

When used with a rope can (10), rope sections (60) are positioned in the cavities formed between adjacent fins (36). The insert (30) is then placed in the can (10) so that the opening (40) is received over the projection (18) while the concave lower surface (34) is matingly received on a portion of the body section (12). Additional cavities to receive and store rope sections (60) are formed between the outermost fins (36), the sidewall (19) and the cover (14).

Figure 4:
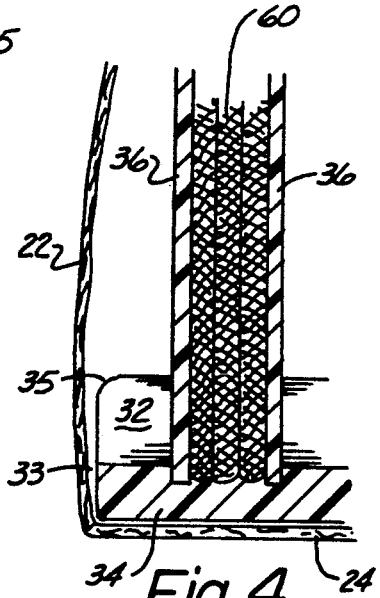
FIG. 4 is a partial sectional view taken along line 4—4 of FIG. 2.
Figure 5:
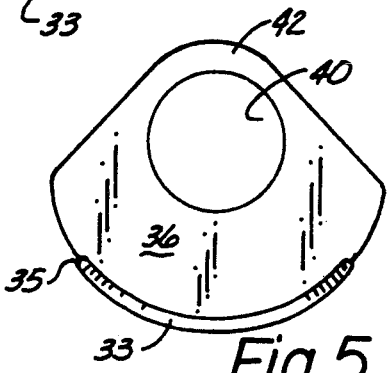
FIG. 5 is a side elevational view of the rope container insert.

When used with a rope bag (20), the insert (30) is placed in the bag (20) through the zippered access opening (28). As best shown in FIGS. 2 and 4, the concave lower surface (34) of the base (32) shapes the flexible intermediate section (24) of the bag (20), and the flexible sidewalls (22) act to form rope cavities with their respective outermost fins (36). The rounded corners (35) of the base (32) minimize wear of the flexible material coming in contact with the base (32).

Thus, it can be seen that at least all of the states objectives have been achieved.

Obviously, many modifications and variations of the present invention are possible in light of the above teachings. It is therefore to be understood that, within the scope of the appended claims, the invention may be practiced otherwise than as specifically described.

I claim:

1. A rope container insert comprising:

a generally rectangular rigid base having a concave lower surface disposed to be received in a rope container such that lateral edges of the base engage walls of the container and the concave lower surface engages a section of the container joining the walls; and a plurality of generally vertical rigid fins, each having a lower convex edge attached to the base, each fin being disposed in spaced relationship from the other to form a plurality of vertical cavities, each cavity disposed to receive and store an individual section of rope, a pair of outermost fins being spaced inwardly from the lateral edges of the base such that a cavity is formed between the container wall and each of the outermost fins, and an interior fin disposed between the outermost fins, the interior fin including an opening in an upper section forming a handle.

2. The rope container insert of claim 1 wherein the rope container is formed of flexible material and wherein the wall-joining section of the rope container is shaped by the concave base.

3. The rope container insert of claim 1 wherein the rope container is formed of a rigid material and wherein the concave base is matingly received on a concave wall-joining section of the rope container.

4. The rope container insert of claim 2 wherein the base includes rounded corners.

5. The rope container insert of claim 3 wherein the opening in the upper section is circular.

6. The rope container insert of claim 5 wherein the circular opening is approximately one-half the overall height of the fin.

7. The rope container insert of claim 5 wherein the container is formed of a rigid material and the circular opening is received over a circular projection extending from a rigid container wall.

* * * * *